US007316633B2

(12) United States Patent
Liao et al.

(10) Patent No.: US 7,316,633 B2
(45) Date of Patent: Jan. 8, 2008

(54) ELLIPTICAL EXERCISE MACHINE

(75) Inventors: Hung-Mao Liao, Taichung (TW); Te-Chang Huang, Chang-Hua Hsien (TW)

(73) Assignee: Johnson Health Tech. Co. Ltd., Taichung Hsien (TW)

( * ) Notice: Subject to any disclaimer, the term of this patent is extended or adjusted under 35 U.S.C. 154(b) by 628 days.

(21) Appl. No.: 10/989,756

(22) Filed: Nov. 15, 2004

(65) Prior Publication Data

US 2006/0046903 A1 Mar. 2, 2006

(30) Foreign Application Priority Data

Sep. 1, 2004 (TW) ..... 93126350 A

(51) Int. Cl.
*A63B 69/16* (2006.01)
*A63B 22/04* (2006.01)

(52) U.S. Cl. ..... 482/52; 482/62; 482/57; 482/70

(58) Field of Classification Search ..... 482/51, 482/52, 57, 62, 70, 79–80
See application file for complete search history.

(56) References Cited

U.S. PATENT DOCUMENTS

| | | | | | |
|---|---|---|---|---|---|
| 5,290,211 | A * | 3/1994 | Stearns | 482/53 |
| 5,299,993 | A * | 4/1994 | Habing | 482/52 |
| 5,540,637 | A * | 7/1996 | Rodgers, Jr. | 482/52 |
| 5,766,113 | A * | 6/1998 | Rodgers, Jr. | 482/52 |
| 5,813,949 | A * | 9/1998 | Rodgers, Jr. | 482/70 |
| 5,865,712 | A * | 2/1999 | Chang | 482/57 |
| 6,045,487 | A * | 4/2000 | Miller | 482/52 |

* cited by examiner

*Primary Examiner*—Stephen R. Crow
(74) *Attorney, Agent, or Firm*—Michael Best & Friedrich LLP

(57) ABSTRACT

An exercise machine includes a pair of slide members having front ends connected to a crank unit for turning along with the crank unit and rear ends linearly slidable on a support. A pair of reciprocating members are mounted on the support for reciprocating forward and backward. A pair of foot support members each have a front pivotal end and a rear free end. The front pivotal end of each foot support member is connected pivotally to one of the slide members between the front and rear ends of the slide member. Each foot support member is connected to one of the reciprocating members rearwardly of the front pivotal end.

6 Claims, 8 Drawing Sheets

ELLIPTICAL EXERCISE MACHINE

CROSS-REFERENCE TO RELATED APPLICATION

This application claims priority of Taiwanese Invention patent application No. 93126350, filed on Sep. 1, 2004.

BACKGROUND OF THE INVENTION

1. Field of the Invention

This invention relates to an exercise machine, more particularly to an elliptical exercise machine which permits the user to exercise by moving his/her feet along an elliptical path.

2. Description of the Related Art

Referring to FIG. 1A, a typical elliptical exercise machine includes a frame 11 which carries a pair of swinging arms 16, a pair of foot members 14 connected to a wheel 12 through cranks 13, and a pair of reciprocating members 17 each of which is connected to one of the swinging arms 16. The foot members 14 are provided respectively with foot platforms 15. The bottom ends of the foot members 14 are slidable along rails provided on the frame 11. When the user stands on the foot platforms 15 and makes an exercise by moving the foot platforms 15 with his feet, the foot members 14 move forward and rearward, and the cranks 13 rotate about the axis of the wheel 12 so that each foot platform 15 ascends and descends along an elliptical path.

However, since the foot platforms 15 are mounted fixedly on the foot members 14, they are immovable relative to the foot members 14. The immovable foot platforms 15 are inflexible and are therefore unable to change their inclining position according to the varying inclining position of the user' feet during the course of exercising movement. Therefore, the foot platforms 15 are unable to contact and support the entire part of the user's feet which tend to incline at different inclining angles during their movements along elliptical paths. Especially, when the user's feet reach their highest or lowest position, they are unsupported at the heels so that the heels are substantially in a suspended position and are vulnerable to strain and fatigue.

U.S. Pat. Nos. 5,540,637 and 5,813,949 also disclose an exercise machine which enables a user to move his feet along an elliptical path. In this machine, foot platforms are supported by respective foot members which are not connected to a crank and which do not slide on the base of a frame. However, like the prior art shown in FIG. 1, the foot platforms of the machine disclosed in each patent are also immovable relative to the foot members so that they cannot provide sufficient support for the user's feet.

FIG. 1B shows an exercise machine including foot platforms 10 each of which is pivotal relative to a foot member 101 to which the foot platform 10 is attached. Each foot platform 10 is pivoted to a fulcrum member 103 which is mounted on the foot member 101 through a pivot pin 104 and is further connected pivotally to a reciprocating member 102 through a head part 105 of the pivot pin 104. While each foot platform 10 is pivotal to move along with the user's foot for providing good support, since it is connected to the foot member 101 only by means of the pivot pin 104 passing through the fulcrum member 103, the exercise machine, when in use, can be subjected to huge bending force and stress concentration at the joint between the foot platform 10 and the foot member 101, thereby resulting in failure of the joint or damage of the machine.

SUMMARY OF THE INVENTION

An object of the present invention is to provide an elliptical exercise machine with a foot support member that is pivotal relative to a slide member to which the foot support member is attached so as to provide good support for the user's foot.

Another object of the present invention is to provide an elliptical exercise machine with an improved arrangement which can minimize stress concentration and bending forces exerted on the exercise machine by the user during exercising.

According to this invention, an exercise machine comprises a support, a pulley mounted on the support, a crank unit connected to the pulley for rotation along with the pulley, a pair of slide members having front ends connected to the crank unit for turning along with the crank unit and rear ends linearly slidable on the support; a pair of reciprocating members mounted on the support for reciprocating forward and backward; and a pair of foot support members each of which has a front pivotal end and a rear free end. The front pivotal end of each of the foot support members is connected pivotally to one of the slide members between the front and rear ends of the one of the slide members. Each of the foot support members is connected to one of the reciprocating members rearwardly of the front pivotal end.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1A:
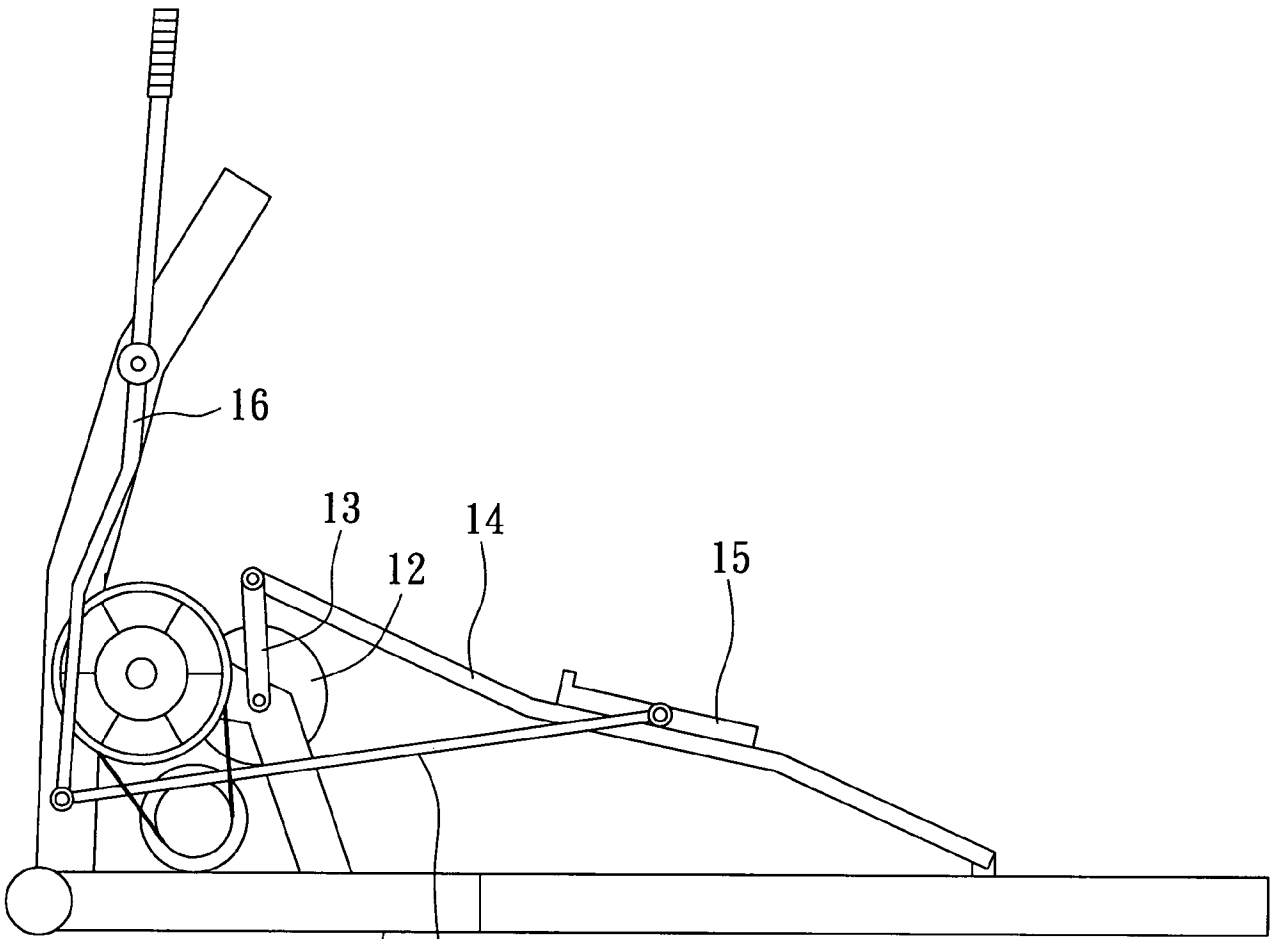
FIG. 1A PRIOR ART
FIG. 1A is a schematic view of a conventional exercise machine.
Figure 1B:
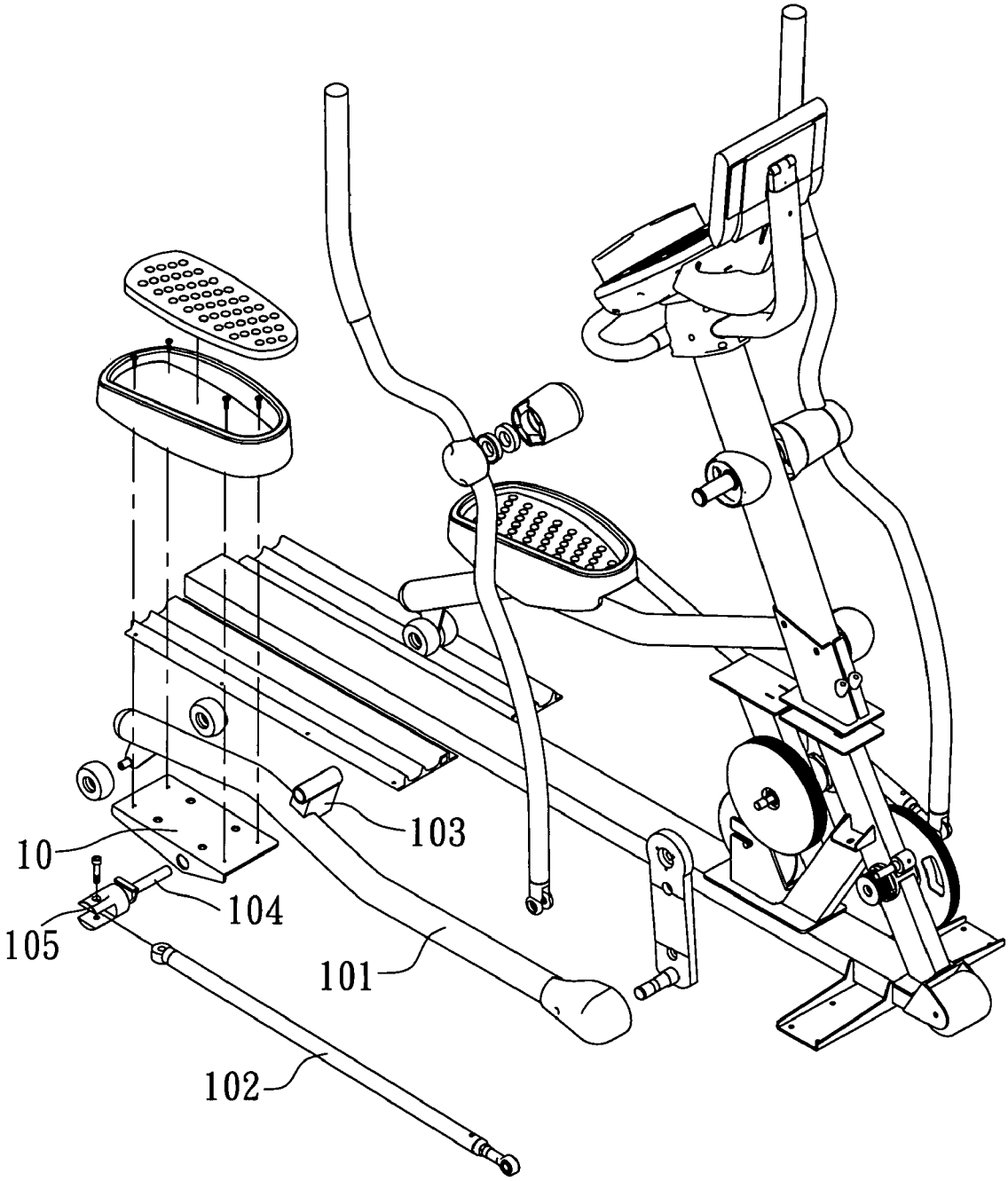
FIG. 1B PRIOR ART
FIG. 1B is an exploded view of another conventional exercise machine.
Figure 2:
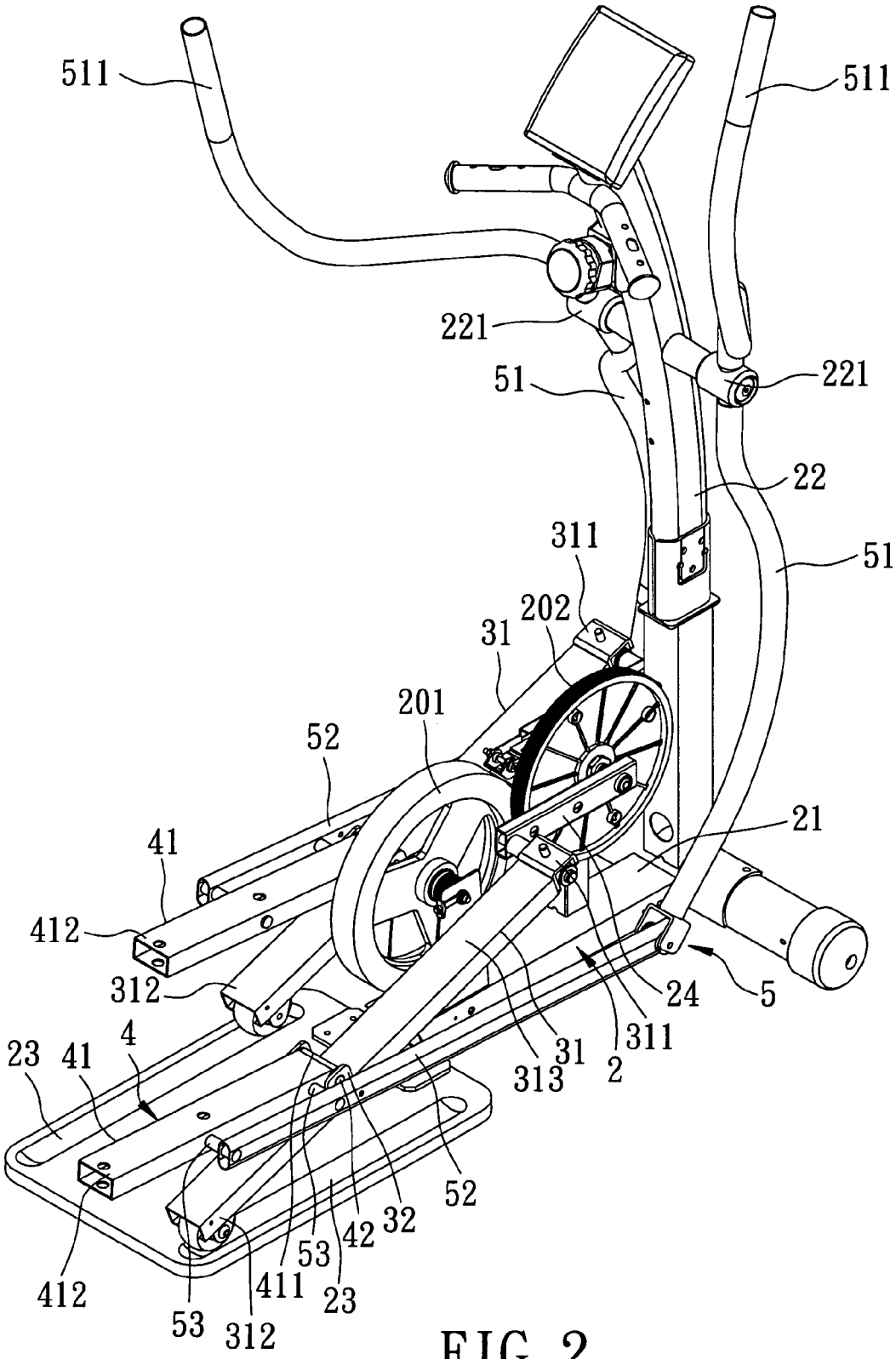
FIG. 2 is a perspective view of an exercise machine embodying the present invention.
Figure 3:
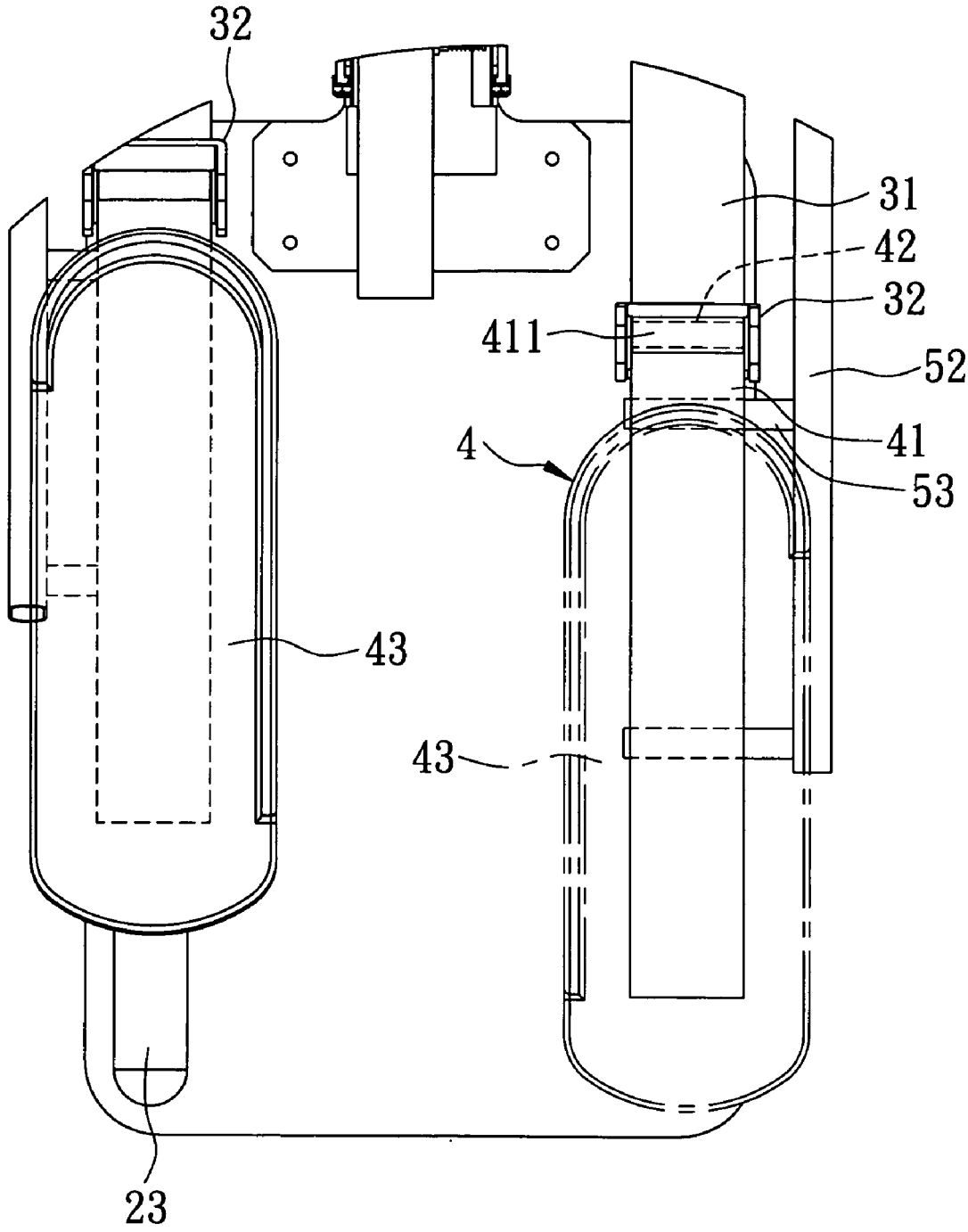
FIG. 3 is a top plan view of the exercise machine of FIG. 2.
Figure 4:
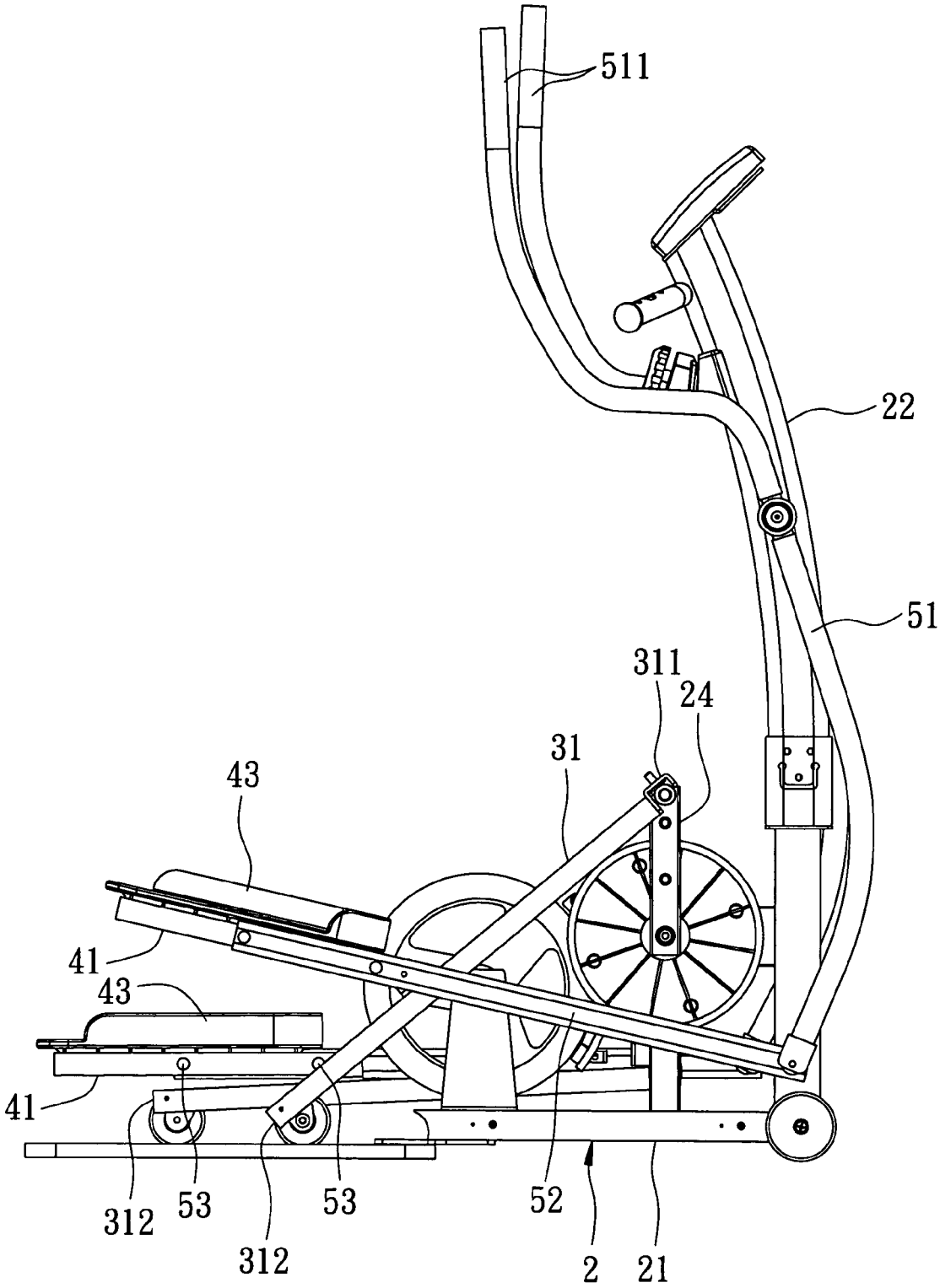
FIG. 4 is a side elevation view of the exercise machine of FIG. 2, illustrating that a foot support member at the right side of the machine reaches a highest level position of an elliptical path.
Figure 5:
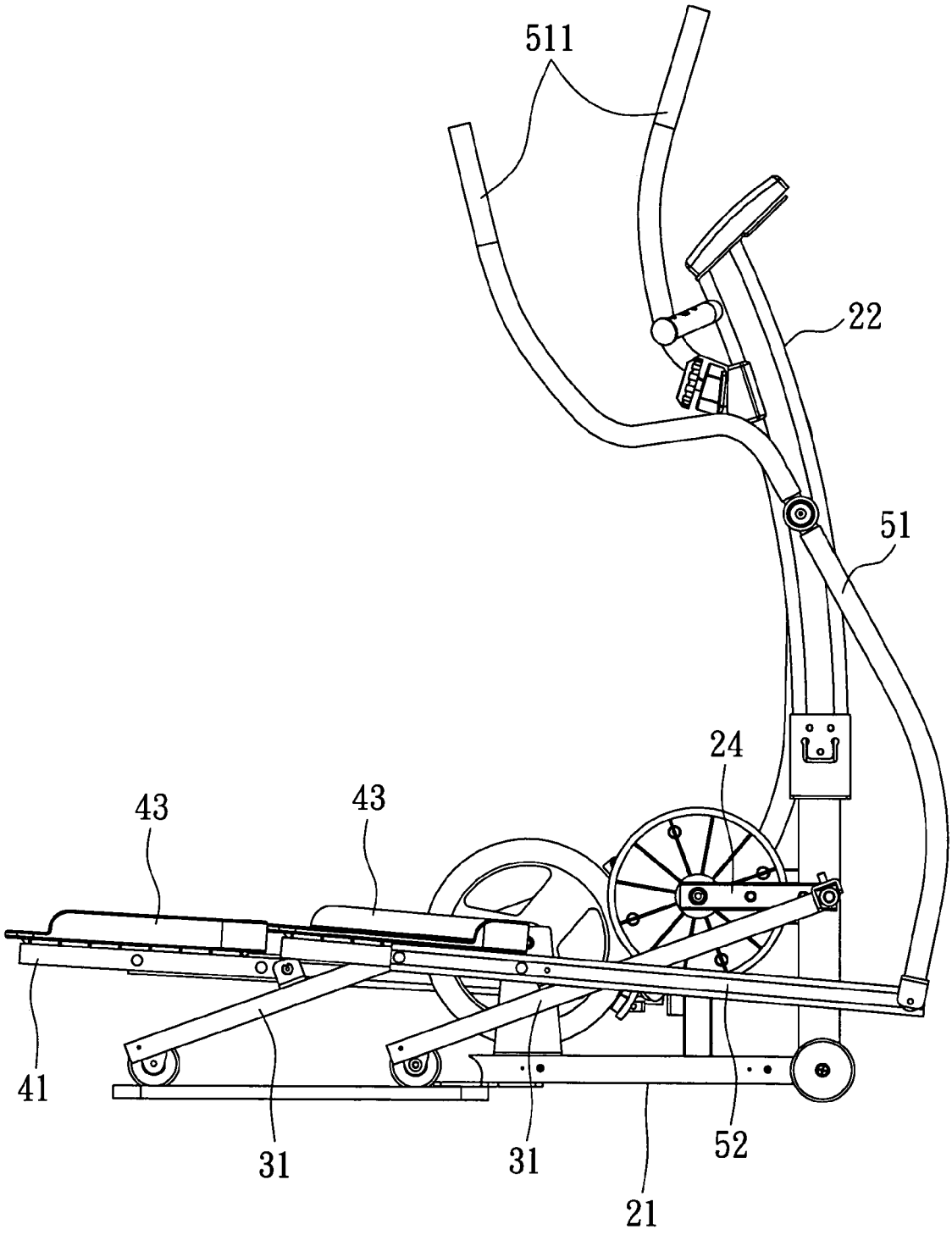
FIG. 5 is the same view as FIG. 4 but with the right side foot support member moving to a frontmost position.

Referring to FIGS. 2 to 7, an exercise machine embodying the present invention includes a support 2 which has a base 21, and an upstanding frame 22 extending upward from the base 21. A flywheel 201 and a pulley 202 are mounted on the base 21 adjacent to the upstanding frame 22. Two slide rails 23 are provided in the base 21 at a rear part of the base 21 distal from the upstanding frame 22. A crank unit includes two crank members 24 which are connected pivotally and respectively to two opposite sides of the pulley 202.

A pair of slide members 31 have front ends 311 connected pivotally to respective crank members 24 for rotation along with the crank members 24. Rear ends 312 of the slide members 31 are wheeled and engaged slidingly with respective slide rails 23 so that the rear ends 312 are slidable linearly on the base 21. Each slide member 31 has a U-shaped pivot seat 32 between the front and rear ends 311 and 312.

A foot support assembly 4 includes two foot support members 41 each of which has a front pivotal end 411 and a rear free end 412. The front pivotal end 411 of each foot support member 41 is connected pivotally to one of the slide members 31 between the front and rear ends 311 and 312 of the corresponding slide member 31 and through the pivot seat 32 and a pivot pin 42. The front pivotal end 411 is located above a top side 313 of the slide member 31. A pedal member 43 is disposed on and fixed to each foot support member 41.

A swinging unit 5 includes a pair of swinging arms 51 and a pair of reciprocating members 52. The swinging arms 51 have top ends connected pivotally and respectively to two connecting members 221 provided at two opposite sides of the upstanding frame 22. The connecting members 221 are in turn connected respectively to bottom ends of two handles 511 so that the handles 511 are swingable together with the respective swinging arms 51. The front end of each reciprocating member 52 is pivoted to the bottom end of the corresponding swinging arm 51. Each reciprocating member 52 is adjacent side by side and is connected immovably to the corresponding foot support member 41 through a fixing unit. Specifically, the fixing unit includes two fasteners or fastening pins 53 which are spaced apart longitudinally from each other and are provided rearwardly of the front pivotal end 411 of each foot support member 41 to connect each foot support member 41 to a rear end portion of the corresponding reciprocating member 52. As such, the foot support members 41 are pivotal with respect to the respective slide members 31 and are immovable with respect to the respective reciprocating members 52.

Referring once again to FIGS. 4 to 7, when the user stands on the pedal members 43 with his feet moving along elliptical paths, the front ends 311 of the slide members 31 move along with the respective crank members 24 along circular paths, and the rear ends 312 of the slide members 31 slide linearly in the respective slide rails 23. As a result, each foot of the user ascends and descends alternately together with the foot support members 41 along an elliptical path. As the foot support members 41 move, the reciprocating members 52 swing reciprocatingly together with the swinging members 51. Due to the swinging movement of the corresponding swinging member 51 about an axis of rotation, the front end of each reciprocating member 52 moves along an arc-shaped path while the rear end of the reciprocating member 52 moves along the elliptical path together with the corresponding foot support member 41. Alternatively, the reciprocating members 52 maybe arranged in such a manner that the front ends of the reciprocating members 52 are slidable on the base 21.

Figure 6:
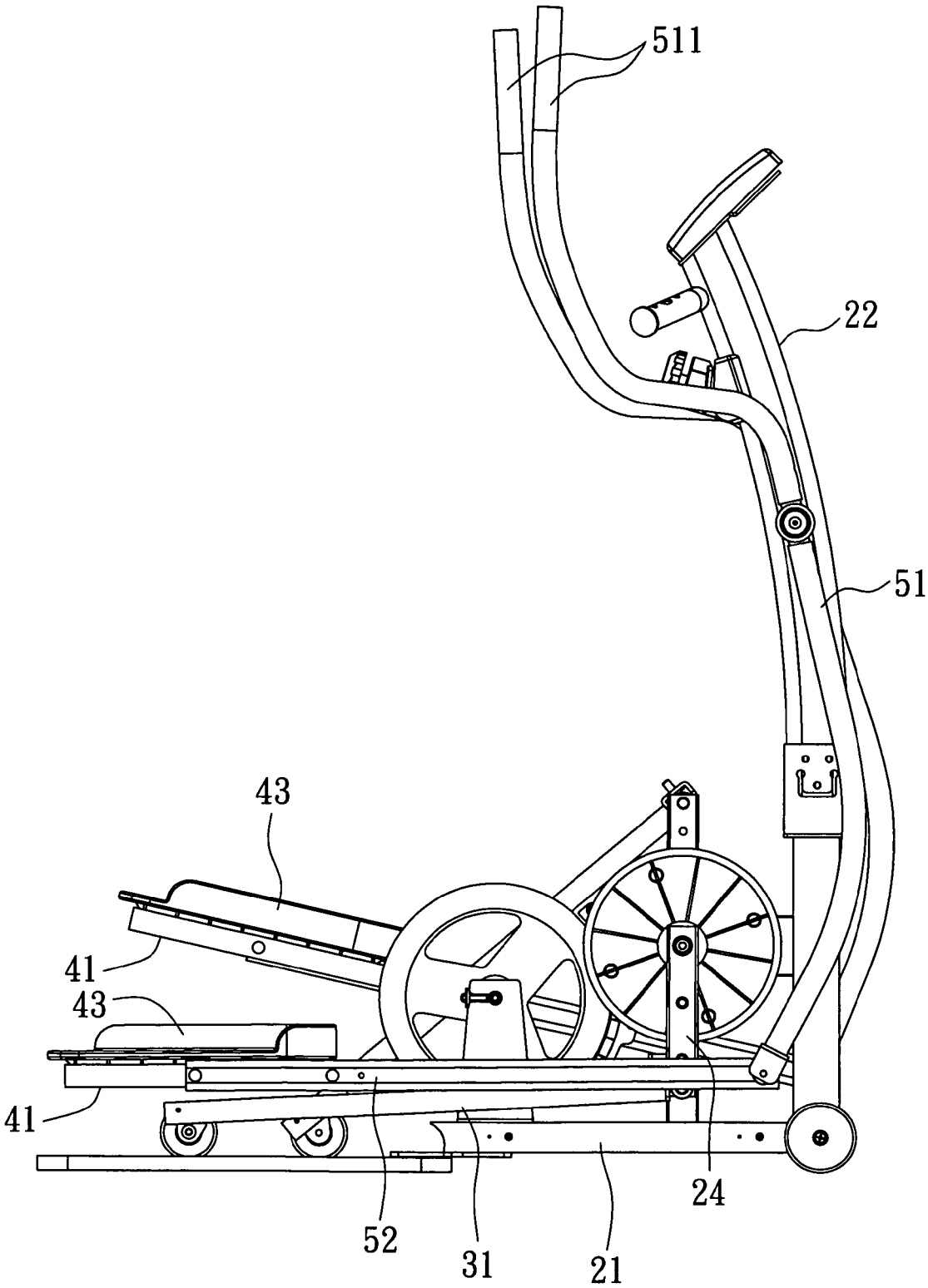
FIG. 6 is the same view as FIG. 4 but with the right side foot support member moving to a lowest level position.
Figure 7:
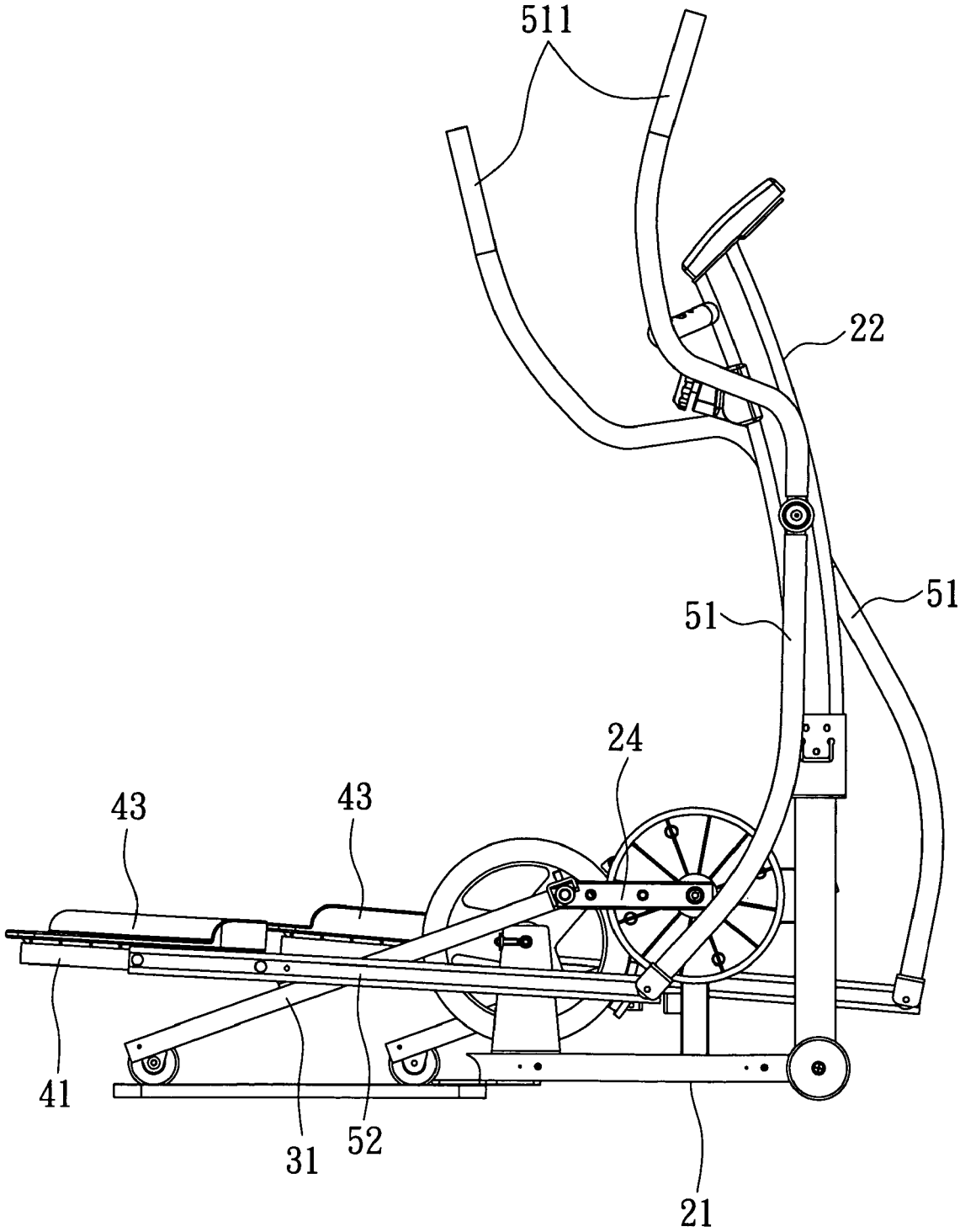
FIG. 7 is the same view as FIG. 4 but with the right side foot support member moving to a rearmost position.

In either case, the reciprocating members 52 can periodically change their inclination angles so that the pedal members 43 on the foot support members 41 will incline upward and downward during the ascent and descent of the foot support members 41. Each pedal member 43 has its surface lying substantially horizontally, as shown in FIG. 6, when reaching substantially a lowest level position of the elliptical path. In other stages, the front end of the pedal members 43 is inclined downward. The pedal member 43 is inclined at the greatest inclining angle (see FIG. 4) when reaching substantially the highest level position of the elliptical path.

Since the foot support members 41 are pivoted to the respective slide members 31 at the front pivotal ends 411 thereof, the rear free ends 412 of the foot support members 41 are permitted to swing within a wide range of angles. As the foot support members 41 are pivotal, each pedal member 43 is permitted to contact substantially the entire part of the user's foot during the exercising movement of the user, thereby providing good support for the user's feet.

In addition, because each foot support member 41 is supported at its front pivotal end 411 by the corresponding slide member 31 and at its intermediate part by the corresponding reciprocating member 52, the dynamic forces exerted on each foot support member 41 by the user during exercising can be shared by the slide member 31 and the reciprocating member 52, thereby avoiding stress concentration, minimizing bending forces, and increasing the durability of the exercise machine.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. An exercise machine comprising:

a support;

a pulley mounted on said support;

a crank unit connected to said pulley for rotation along with said pulley;

a pair of slide members having front ends connected to said crank unit for turning along with said crank unit and rear ends linearly slidable on said support;

a pair of reciprocating members mounted movably on said support for reciprocating forward and backward;

a pair of foot support members each of which has a front pivotal end and a rear free end, said front pivotal end of each of said foot support members being connected pivotally to one of said slide members between said front and rear ends of said one of said slide members, each of said foot support members being connected to one of said reciprocating members rearwardly of said front pivotal end.

2. The exercise machine as claimed in claim 1, wherein said support includes a base and an upstanding frame extending upward from a front end of said base, said pulley being mounted on said base adjacent said upstanding frame.

3. The exercise machine as claimed in claim 2, further comprising a pair of handles mounted pivotally on said upstanding frame, and a pair of swinging arms mounted pivotally on said upstanding frame and connected respectively to said handles for swinging simultaneously with said handles, each of said swinging arms having a top end connected to a corresponding one of said handles and a bottom end connected to a front end of one of said reciprocating members.

4. The exercise machine as claimed in claim 1, wherein each of said slide members includes a top side opposite to said base, and a pivot member mounted on said top side and connected pivotally to said front pivotal end of a corresponding one of said foot support members.

5. The exercise machine as claimed in claim 4, wherein each of said reciprocating members has a fixing unit which is provided rearwardly of said front pivotal end of a corresponding one of said foot support members, each of said foot support members being connected immovably to one of said reciprocating members through said fixing unit.

6. The exercise machine as claimed in claim 5, wherein said fixing unit includes two fasteners that are spaced apart longitudinally from each other.

* * * * *